United States Patent [19]

Gerundt et al.

[11] Patent Number: 4,614,969

[45] Date of Patent: Sep. 30, 1986

[54] PROCESS FOR MANUFACTURING AN ENDLESS TUBULAR FELT AND APPARATUS FOR IMPLEMENTING THE PROCESS

[75] Inventors: Sebastian Gerundt, Alsdorf; Rolf Guse, Reutlingen; Walter Halterbeck, Düren; Günter Hollenberg, Kreuzau-Winden; Gerhard Maier, Neuhausen; Karl-Heinz Müller, Düren, all of Fed. Rep. of Germany

[73] Assignee: Thomas Josef Heimbach GmbH, Co., Düren-Mariaweiler, Fed. Rep. of Germany

[21] Appl. No.: 603,324

[22] Filed: Apr. 24, 1984

[30] Foreign Application Priority Data

Mar. 27, 1983 [DE] Fed. Rep. of Germany ..... 3319241
Apr. 30, 1983 [DE] Fed. Rep. of Germany ..... 3315834

[51] Int. Cl.[4] ..... H04N 7/18

[52] U.S. Cl. ..... 358/101; 28/110; 358/93; 364/470

[58] Field of Search ..... 358/101, 93; 364/470; 28/103, 107–115

[56] References Cited

U.S. PATENT DOCUMENTS

| | | | |
|---|---|---|---|
| 3,101,175 | 8/1963 | Brown | 358/101 |
| 3,508,307 | 4/1970 | Dilo | 28/110 |
| 4,253,112 | 2/1981 | Doemens | 358/101 |

FOREIGN PATENT DOCUMENTS 1377037 12/1974 United Kingdom .

*Primary Examiner*—Howard W. Britton
*Attorney, Agent, or Firm*—Shlesinger, Arkwright, Garvey & Fado

[57] ABSTRACT

A method and apparatus for producing an endless tubular felt includes superposing layers of tubular felt one upon the other and binding of the superposed layers together. A marking line is applied to the top surface of the superposed layers in continuous manner as the felt is trained about the driven rolls. The rolls include needle segments which move the felt axially of the roll. A scanner scans the position of the marking line shortly before the completion of one revolution. A controller compares the position of the marking line with a reference and causes the needle means to be adjusted to that the marking line corresponds with the reference.

20 Claims, 10 Drawing Figures

12
13
10
11
A
13
3
1
2
14
11
5
4
15

12
11
10
D
13
13
13
13
14
3
6
B
1
7
C
2
4
5
8
9

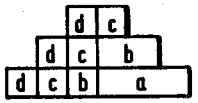
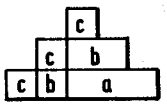
Fig. 3
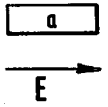
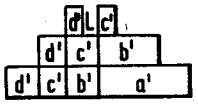
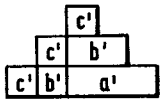
Fig. 4
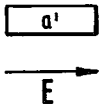
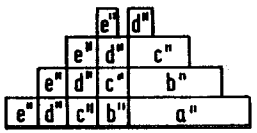
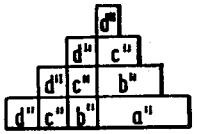
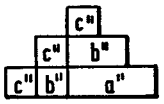
Fig. 5
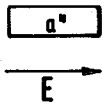

RECTIFIER
62
SWITCH
60
DETECTOR
69
ANALYZER
75
OPERATING MEANS
70
RELAY
61
CONTROL CIRCUIT
68
COUPLER
63
OUTPUT MULTIPLEXER
67
INPUT MULTIPLEXER
64
BUFFER
76
SELECTION CIRCUIT
71
OUTPUT PORT
INPUT PORT
INPUT PORT
INPUT PORT
OUTPUT PORT
INTERRUPT
INPUT PORT
66
65
77
72
73
78
74
59

PROCESS FOR MANUFACTURING AN ENDLESS TUBULAR FELT AND APPARATUS FOR IMPLEMENTING THE PROCESS

BACKGROUND OF THE INVENTION

The invention concerns a process for manufacturing and/or treating an endless tubular felt or similar tubular structure. A material, for instance, a fiber web, a coating, longitudinal threads or the like, are deposited continuously across the width. An at least partially prepared tubular felt revolves circumferentially with the deposition being in that direction. The tubular felt may be treated across a width which has been singed or needled and with the width being less than the width of the tubular felt. The deposition or the treatment takes place, respectively, by a relative motion of, or toward, the tubular felt in a helical manner transversely to its direction of advance and possibly with partial overlap. The invention further relates to an apparatus to implement this process and comprises at least two mutually spaced conveyor rollers for the already-prepared part of the tubular felt. A feed system for depositing the material on the already-prepared part of the tubular felt and/or with a treatment system for said part is disclosed. A displacement device for the relative motion between the tubular felt and the feed system or the treatment system is provided in the axial direction of the conveyor rollers.

Such a process and pertinent equipment is disclosed in the German Pat. No. 16 60 765. To that end, the equipment includes two mutually adjustable conveyor rollers on which the already-prepared part of the tubular felt moves. A fiber-web is continuously supplied in the direction of rotation of the tubular felt in such a manner that this length of fiber web partly overlaps the already-prepared tubular felt by one edge. After the fiber web is deposited, it is needled to the tubular felt. Grooves are fashioned into the conveyor rollers parallel to their longitudinal axes and are adapted to receive moving conveyor chains which support needles for penetrating the felt. These conveyor chains slowly displace the tubular felt transversely to its direction of advance, whereby the tubular felt is gradually built-up over its entire width. It has been found in practice that the transverse motion of the tubular felt does not coincide with the motion of the conveyor chains. This was noted when the computed tube width was not obtained after a computed number of tube revolutions. The reasons for this discrepancy have not been reliably ascertained. As a consequence, the specific weight per area and hence the thickness of the particular tubular felt varies greatly and, consequently, the dehydration properties and also the service life of the tubular felt are degraded when used in a paper-making machine.

The equipment disclosed in the German Auslegeschrift No. 23 24 985 operates in the kinematic reverse order. In this equipment, the tubular felt is not displaced transversely but rather the feed system for the fiber web is. However, the tubular felt is similarly formed by the length of fiber web being opposed helically with partial overlap.

In this instance, too, the lengths of fiber web must be so deposited that there will be no changes in specific weight per area or thickness. These changes may be caused, for instance, by an uncontrolled drift of the tube on the conveyor rollers or by fluctuations in the transverse motion of the feed system.

Similar problems are incurred if in lieu of a length of fiber web, coatings or chemicals are deposited in helical manner. Again, the spacings of the "pitches" on the tubular felt must always be of a predetermined value in order to have uniform deposition.

Similar considerations apply to treatments and procedures such as singeing, needling, brushing or the like. One may move a corresponding device of lesser width across the width of the circumferentially rotating tubular felt or, vice-versa, the tubular felt can be moved transversely underneath the stationary device. Similar kinematic relations apply when treating tubular felts or corresponding tubular structures in roll calenders.

Lastly, threads forming longitudinal dehydration channels which are mutually spaced apart can also be deposited to form a tubular felt by placing one or more threads next to each other in the gaps of a reed on the surface of the tubular felt. By transversely moving either the tubular felt or the feed system for the threads, these threads may be arrayed helically on the tubular felt. Uniformly spaced filaments are also essential in this instance.

OBJECTS AND SUMMARY OF THE INVENTION

It is the object of the invention to so improve the initially cited process that there results a uniform material deposition or a uniform treatment of the tubular felt.

Another object is to provide an apparatus to carry out this process.

The first stated object is solved by the invention in that at least one marking line, in contrast with the tubular felt, is continuously deposited on said felt in its circumferential direction of advance. The position of said marking line, or its spacing from a neighboring one toward the rear, as shown from the direction of advance, is sensed in a contact-free manner as the actual value. The relative motion is always set so that the sensed actual value deviates as little as possible from a specific reference value. In a manner of speaking, the marking line acts as an indicator of the actual relative motion between the tubular felt and the deposition or the treatment. The transverse displacement of the marking line from the place where it was deposited is sensed in a contact-free manner and this actual value is then compared to a reference value. The actual value can be balanced against the reference value by a fine-control for the transverse motion drive and thereby a most uniform transverse motion is achieved. This uniform transverse motion assures, for instance, in the case of the deposition of a fiber web, that the continuous build-up of the tubular felt takes place in optimal manner with the thickness being substantially the same across the whole width.

The sensing of the marking line can be performed at various sites. It was found advantageous to sense the position of the making line before the tubular felt with the marking line has carried out a full revolution. In this range, the transverse motion is especially clear and hence easily sensed, although suffering from the drawback that this sensing occurs shortly before a full revolution is completed.

Alternatively to sensing the position of the marking thread upon completing a specified path, one can also sense the spacing between the revolution(s) of a marking line. In that event, the marking line forms a helical line on the already-prepared tubular felt, the spacing between the adjacent parts of the line being a measure of the particular transverse motion.

Such a measurement of the spacing also can be carried out when a first marking line and a second marking line behind said first, as seen in the direction of advance and at a spacing from it, are deposited, with the sensing of the spacing between the two marking lines then being carried out. This procedure offers the advantage of not having to wait for a full revolution of the marking line before sensing the spacing.

Just because the marking line is continuously deposited does not mean that it must be uninterrupted. It also suffices if the marking line consists of dashes or dots. An ink or color which can be rinsed out, for example, is suitable material for the marking line. It was found especially appropriate to use marking threads having a strong color contrast compared to the color of the tubular felt as the marking line. Appropriate marking threads are yarns which are as smooth as possible, in particular when, in an especially advantageous manner, the marking filament is deposited before a length of fiber web is fastened to the already-prepared part of the tubular felt. In that case the marking thread is so needled to the tubular felt that it will not change its position thereafter. Despite this needling operation, the thread can be removed without problems after the sensing and without damaging the tubular felt.

Where the marking line contrasts optically with the tubular felt, optical procedures are especially applicable as the sensing methods.

An apparatus to implement this process is disclosed in the invention and includes at least one deposition system continuously depositing the marking line on the tubular felt along its circumferential direction. A sensing system operating in contact-free manner detects the position of the marking line or its spacing from a neighboring marking line which, as seen in the direction of advance, is located behind the deposition system(s). The deposition system(s) and the sensing system are fixed in position and with respect to each other when the tubular felt is moved transversely and are coupled to the displacement device when the feed system or the treatment system is moved transversely. The sensing system is connected to an electronic analyzer which ascertains the difference between the actual value of the position or the spacing between the marking line(s) on one hand and on the other the reference value provided for that purpose. The analyzing unit is connected to a regulator adapted for ascertaining the setting value and for adjusting the drive of the displacement device for minimizing the difference. The apparatus of the invention is therefore provided with a regulator for implementing the process of the invention. The actual value of the transverse displacement fed to the regulator is obtained from the position of the marking line or from the spacing between two neighboring marking lines. The regulator so acts on the displacement device that the actual transverse displacement of the tubular felt corresponds as uniformly as possible to a pre-determined reference value.

In the embodiment of the invention, the deposition system(s) is (are) mounted in front of a fastening device. This is especially advantageous if the marking line is in the form of a marking thread because the latter is then fixed by the fastening device onto the tubular felt.

When the spacing between two marking lines is used as the actual value in controlling the transverse motion, a second deposition system can be mounted behind the first as seen in the direction of advance. The magnitude of the spacing between the marking lines deposited by the two deposition systems in this case corresponds to the actual transverse motion of the tubular felt.

Alternatively, the sensor means can be mounted between adjacent parts of the marking line after more than one revolution. The sensor can be designed to detect the spacing between the two adjacent parts of this marking line. In that case, however, while the spacing is also sensed as the actual value, only one marking line need be deposited.

A further feature of the invention provides that the sensor is mounted in the vicinity of the marking line shortly before the completion of one revolution and that the sensor is designed to detect the position of the marking line. In practice, this sensor was found useful in spite of the relatively large distance between the depositing and sensing of the marking line because the change in position is especially noticeable in this vicinity when there is a change in the transverse motion.

The invention further provides that the marking line(s) optically contrasts with the tubular felt and that the sensor is an electronic-optical type. This provides the simplest method for depositing a marking line and sensing it. This sensing may include a light detector of the known type of scanners or light-interruption detectors.

However, another alternative found to be problem-free was to provide the sensor with an imaging device. This can be implemented, for instance, with a semiconductor imaging sensor of the CCD techniques. These detectors are still relatively expensive and accordingly, at the present, the imaging device more likely will be a video camera, especially one with a vidicon tube.

The video camera is arranged such that the marking line(s) run parallel to the camera's scanning lines in order to obtain a video signal of constant signal amplitude between two line sweep pulses. Additionally and preferably, the video camera and the marking line(s) are adjusted with respect to each other so so that the marking line(s) require(s) at least six scanning lines. The purpose is to obtain a clear video signal regardless of any spurious pulses.

Appropriately, the analyzer includes a detector circuit to detect the marking line(s) and a counter circuit to count the scanning lines from the beginning of the image to the video signal of the marking line(s) and/or between two such video signals. The count is the actual value to be used by the regulator. The detector circuit may be designed to include a shift register which is synchronized by the line sweep pulses of the video camera and which is reset each time by the sweep pulses of the video camera for the purpose of transmitting line sweep pulses. The video signal controls an input port so that only the line sweep pulses enter the shift register in the presence of the video signal from the marking line(s). The shift register should be followed by an AND circuit emitting a signal only when three consecutive line sweep pulses are present. In this manner, signal transmission is extensively assured against any spurious pulses.

The counter circuit, in a further feature of the invention, consists of a line sweep pulse counter, a line sweep pulse memory connected to said counter and also a counter fed by a multivibrator. This latter counter is controlled by every second sweep pulse in such a manner that the line sweep pulse memory receives a transfer pulse to accept the count in the line sweep pulse counter and then the line sweep pulse counter receives a reset-pulse before the next line sweep pulse arrives. By means of this circuit, the line sweep pulses of two half images are recorded in the line sweep pulse counter and are fed into a memory. The line sweep pulse counter is reset into its initial state and it can again record the line sweep pulses of two half images.

A gate may be provided in front of the input to the line sweep pulse counter. The gate is controlled by the detector circuit through the use of a counting flip-flop and it will be blocking in the presence of a signal from the detector circuit and transmitting in the presence of an image sweep pulse. In this manner, only the line sweep pulses which were obtained from the beginning of the half image to the complete detection of the marking line are fed into the line sweep pulse counter.

In order that the spacing between the two marking lines will be detectable, a data flip-flop is provided in parallel with the counter flip-flop and can be switched to the gate in lieu of said counter flip-flop. The data flip-flop is controlled by the counter flip-flop and the detector circuit and in the presence of a first signal from the detector circuit the gate will be made transmitting and in the presence of a second signal it will again be blocking.

The regulator appropriately is a PI control. Such a regulator was found adequate and therefore a PID control is not necessary.

It was found to be especially advantageous to control the regulator by using a microprocessor because in that case a very flexible control is possible by the use of corresponding software.

Appropriately, the reference value input and the setting value output are implemented by an optical coupler so that the microprocessor is electrically isolated from the input and output.

The invention further provides that the deposit system(s) comprise(s) a spool holding the marking thread. A storage supply preferably is mounted between the spool and the tubular felt so that the marking thread can be taken off the spool in a problem-free manner. A guide plate is provided with a guide groove and, preferably, moves the marking thread onto the tubular felt.

Moreover, a take-off means preferably is provided for the marking thread and consists of a motor-driven spool. Appropriately, switches are provided to control the spool drive as a function of the take-off angle of the marking thread so that precise synchronization with the rotation of the tubular felt will not be necessary.

DESCRIPTION OF THE DRAWINGS

FIG. 3 schematically shows the build-up of the tubular felt when the transverse motion is correct, FIG. 4 schematically shows the build-up of the tubular felt when the transverse motion is excessive, FIG. 5 schematically shows the build-up of the tubular felt when the transverse motion is insufficient, FIG. 6 schematically shows in sideview the feed of a marking thread, FIG. 7 schematically shows the take-off means for the marking thread.

DESCRIPTION OF THE INVENTION

Figure 1:
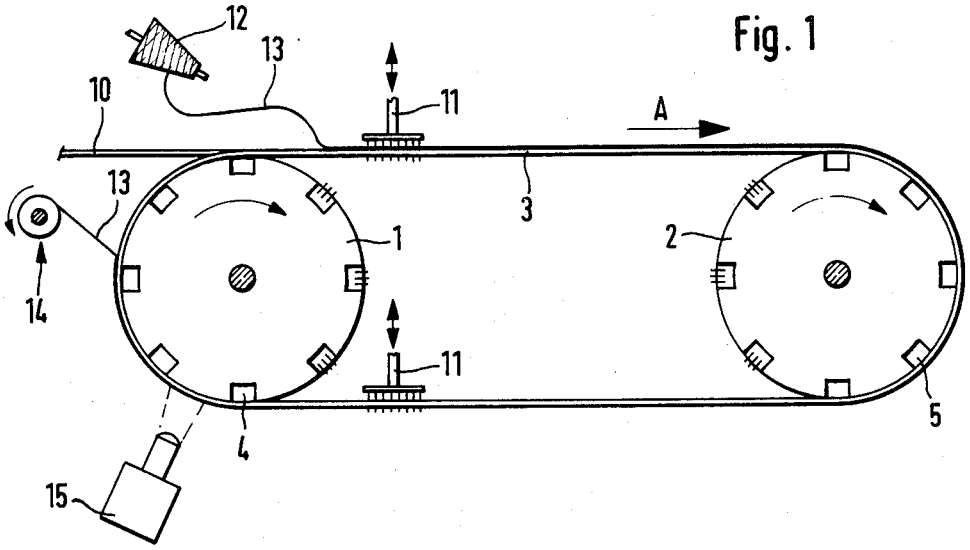
FIG. 1 is a schematic sideview.
Figure 2:
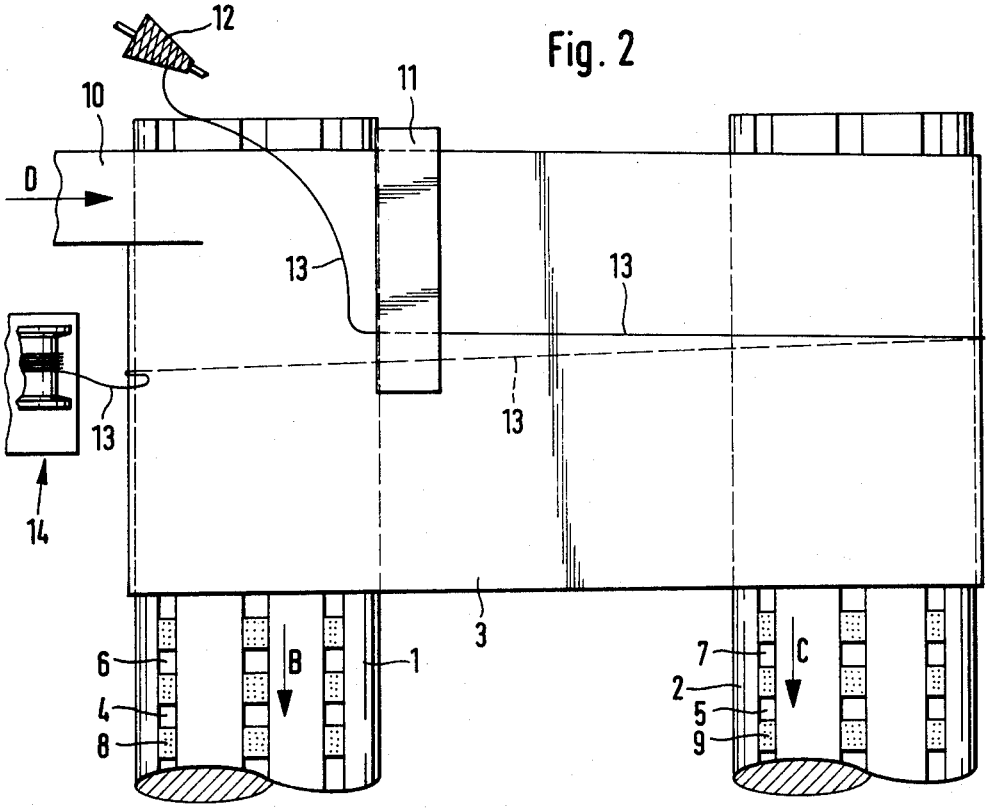
FIG. 2 is a top view of an apparatus for manufacturing a tubular felt.

The apparatus, as best shown in FIGS. 1 and 2, essentially consists of two mutually spaced and axially parallel conveyor rollers 1,2 around which an already partly built-up tubular felt is guided. The conveyor rollers are provided with grooves 4,5, parallel to their axes and distributed across their circumferences, inside which grooves are guided conveyor chains 6,7. These conveyor chains hold needle segments 8,9 for penetrating the tubular felt 3.

The conveyor rollers 1,2 rotate the tubular felt 3 in the direction of the arrow A. Simultaneously, the tubular felt 3 is displaced transversely by the conveyor chains 6,7 and needle segments 8,9 in the direction of the arrows B,C.

A length of fiber web 10 is deposited on the upper edge of the tubular felt 3 of FIG. 2. This fiber web is supplied from a card and moves in the direction of the arrow D. The fiber web 10, in this procedure, overlaps by two-thirds of its width the already built-up tubular felt 3. It is fastened by a needling machine 11 located behind the first conveyor roller 1 and is fixed to the tubular felt 3. FIG. 1 shows dual needling machine 11 which fix the tubular felt 3 both at the upper and the lower sides of the felt 3. So far, this apparatus coincides generally with the equipment disclosed in the German Pat. No. 16 60 765.

As indicated merely in schematic manner in FIGS. 1 and 2, but in further detail in FIG. 6, a marking thread 13 is taken from cone 12 and is deposited by means of devices further described below at a given site on the tubular felt 3. This occurs in front of the needling machine 11 so that the marking thread 13 is needled to the tubular felt 3. The marking thread 13 then moves together with the tubular felt 3 along the helical line shown in FIG. 2. Near the conveyor roller 1, this thread is removed by a winding means 14 from the surface of the tubular felt 3 and is wound on said means. Before that, however, the position it assumed on account of the transverse motion was recorded by a video camera 15 having a vidicon tube.

The marking thread 13 and the location of the video camera 15 are mutually arranged so that the marking thread 13 will be parallel to the scanning lines of the video camera 15 in the recorded video image and that the video camera 15 records the marking thread 13 by at least 6 scan lines, i.e. at least 3 scan lines per half image. Illuminating means may be mounted beside the video camera 15 so that the marking thread 13 contrasts as much as possible with the surface of the tubular felt 3. Furthermore, maximum color contrast between the said thread and the color of the tubular felt 3 is preferred. This can be achieved as a rule by using a deep black thread while the tubular felt 3 typically is very light.

The most desirable marking thread 13 is a thread which is as smooth as possible but which has a fiber structure to permit it to be needled and fixed into the surface of the tubular felt 3. Obviously, the marking line 13 can also be replaced by one deposited using crayons or the like, also fluorescent inks. Additionally, metal threads may be deposited, provided the sensor means are appropriate.

FIGS. 3 through 5 show the stepwise build up caused by superimposed portions of the tubular felt. First, a length of fiber web a, here shown in cross-section, is provided. Another length of fiber web b is deposited on the first one in such a manner that two thirds of its width will rest on the length of fiber web a and one third of the width projects at the left edge. Another length of fiber web c is next deposited on the length of fiber web b so as to overlap it by two thirds and then a length d on the length c. The subsequent lengths of fiber web in turn are deposited in the same manner on the particular preceding lengths of fiber web as is the length d. It can be seen that the tubular felt built-up in this manner results in three plies of fiber webs which are mutually needled. In the example of FIG. 3, the transverse displacement is optimal and therefore the specific weight per area is uniform.

In principle, FIG. 4 shows the same build up of a tubular felt except that in this case the transverse displacement in the direction of the arrow E is excessive. In this case, the overlap of the fiber web b' with the fiber web a' is less than two thirds its width. This continues, of course, with the fiber web c' and the fiber web d'. A gap occurs between the particular upper parts of the fiber webs c' and d'. Theoretically, the thickness is only double that of a single length of fiber web in lieu of the desired triple amount. Such a discontinuity in thickness degrades the properties of the tubular felt but frequently took place with the equipment of the German Pat. No. 16 60 765.

Similar conditions apply when, as shown in FIG. 5, the transverse motion in the direction of the arrow E is too slow. It can be seen that then the overlap between the length of fiber web b'' and the length of fiber web a'' is more than two thirds of the width of the length of fiber web b''. This continues with the fiber webs c'' and d'' and upon depositing the fiber web d'', the theoretical thickness of the tubular felt in a segment is four-fold that of one fiber-web ply. This becomes even clearer in the latter case when depositing a further length of fiber web e''. A tubular felt now has been made with a theoretical thickness of four fiber web plies, the periodically occurring gaps causing large differences in thickness and hence in specific weights per unit area. To prevent the conditions shown in FIGS. 4 and 5, a regulator is provided which is described further below.

Figure 6:
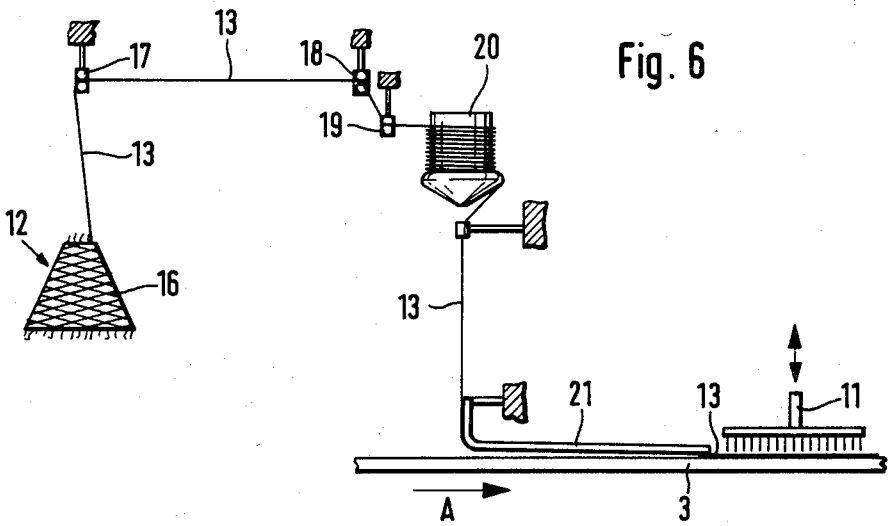

FIG. 6 shows in further detail the deposition system for the marking thread 13. FIG. 6 is a side view and the arrow A denotes the direction of motion of the tubular felt 3. Initially, the marking thread 13 is stored on a cone 12 which is provided with a takeoff net 16. The marking thread is taken off the cone 12 at its head and passes through the guide eyes 17, 18, 19 to arrive at a supply spool 20, as is known in knitting. This supply spool 20 periodically replenishes its yarn supply and ensures constant yarn takeoff tension.

The marking thread 13 is taken off the supply spool 20 by the motion of the tubular felt 3 and is deposited by guide plate 21, having guide grooves, onto the tubular felt 3 and directly thereafter is fastened by the needling machine 11. This arrangement assures that the marking thread 13 always is deposited at the same place and with the most uniform possible takeoff tension on the tubular felt 3.

Figure 7:
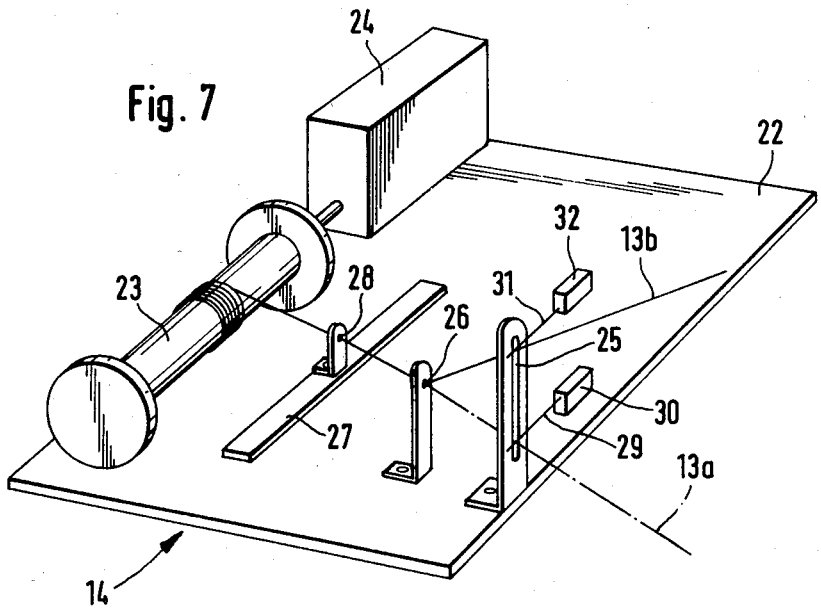

The takeoff device 14, shown in FIG. 7, includes a base plate 22 rotatably supporting a takeoff spool 23 driven by a drive motor 24. The marking thread 13 passes from the (omitted) tubular felt 3 into the takeoff device 14, through slotted eye 25, fixed eye 26 and eye 28 which is guided in displaceable manner in the transverse direction on a rail 27, and finally arrives at the takeoff spool 23. The eye 28 is displaced from time to time so that the marking thread 13 is wound uniformly across the width of the take-off spool 23.

The drive motor 24 is set in such a manner that more marking thread 13 will be taken off by the takeoff spool 23 than is required. Due to the tension exerted, the marking thread 13 moves into the position 13*a* shown in dashed lines. When in that position, a switch 30 is actuated by sensor 29 which turns off drive motor 24 whereby the marking thread 13 no longer is wound onto the takeoff spool 23. Soon the marking thread 13 assumes the position 13*b* shown in solid lines wherein it actuates the actuator 31 of switch 32. This switch 32 turns on the drive motor 24 whereby the marking thread 13 is rewound. In this manner, the marking thread 13 is removed in a problem-free manner from the tubular felt 3.

Figure 8:
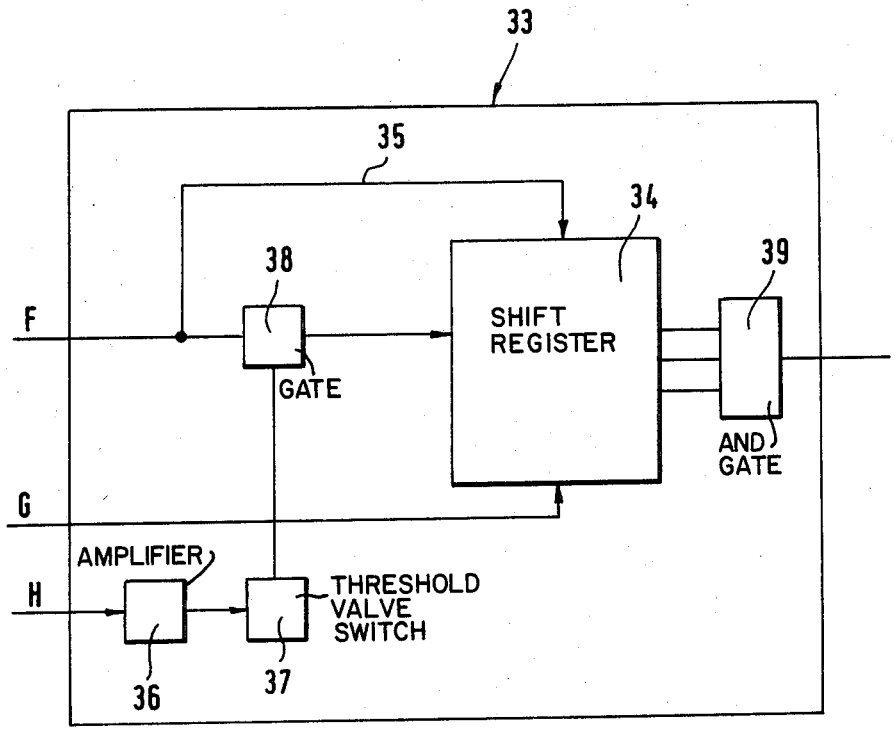
FIG. 8 is a block circuit diagram of a detector circuit for a video camera signal analyzer.
Figure 9:
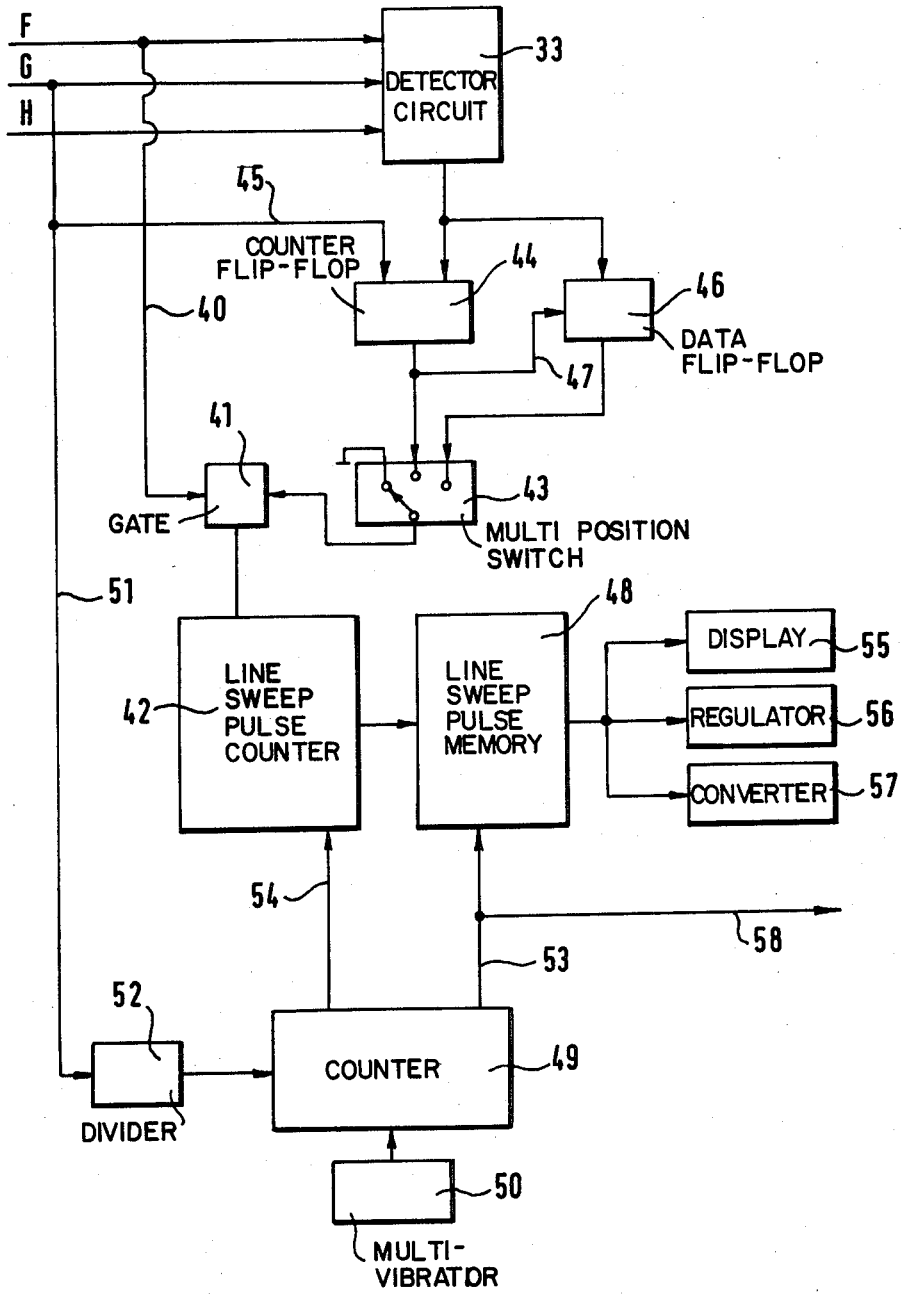
FIG. 9 is a block circuit diagram of the analyzer with the detector circuit of FIG. 8, and, FIG. 10 is a block circuit diagram of a regulator controlled by the analyzer of FIG. 9.

The block circuit diagram shown in FIG. 8 discloses a detector circuit 33 for an analyzer, shown in further detail in FIG. 9, and which is connected to the video camera 15 of FIG. 1. The image projected on the vidicon tube is resolved conventionally into 625 scanning lines, with every second line being scanned sequentially. Therefore, one image is resolved into two half-images and transmitted.

The video camera 15 emits a video signal, the voltage of which is proportional to the image part that was just scanned. As already described above, the video camera in this instance is arranged in such a manner that the marking thread 13 runs parallel to the scan lines, whereby the marking thread is scanned by the vidicon tube as darkened lines thereby generating a corresponding video signal. Additionally, the video camera 15 provides pulses which, on one hand, indicate the beginning of the scanning of a half image, the so-called image sweep pulses, and, on the other hand, signals the beginning of the scanning of a line, namely the so-called line sweep pulses.

The detector circuit 33 includes a shift register 34, the input of which is fed with line sweep pulses F. By means of a parallel conductor 35, the line sweep pulses simultaneously synchronize the shift register 34. The image sweep pulses G are fed into another input of the shift register 34. These image sweep pulses 34 reset the shift register into a defined initial state when a half image is being scanned. The video signal H first arrives at an amplifier 36 and then at a threshold-value switch 37. This switch causes gate 38 to be conducting the moment a video signal H is received that has scanned a dark line originating from the marking thread 13. Once the gate is conducting, a line sweep pulse F arrives in the shift register 34. If the next scanned line also is dark, the next line sweep pulse F also is fed into the shift register. Again, the same operation takes place if the third scanned line also is dark.

An AND gate 39 connected to the shift register 34 only transmits a signal when at least three consecutive line sweep pulses F have been moved through the shift register 34. The output signal then means "marking thread recognized". After the first half image has moved through, the shift register 34 is reset by the image sweep pulse G and now is ready to receive line sweep pulses F from the second half image. Accordingly, the gate 38 is made conducting again for the line sweep pulses F the moment a video signal H from the scanning of dark lines is present. Therefore, one output signal is generated for each half image behind the AND gate 39.

FIG. 9 is the block circuit diagram of the entire analyzer, with the detector circuit 33, however, being indicated in this figure only as a single block. The line sweep pulses F pass through a conductor 40 into a gate 41 and from there into a line sweep pulse counter 42 where they will be counted, provided the gate 41 is conducting. The gate 41 is controlled by a multi-position switch 43. For the shown position of the multi-position switch 43, the gate 41 is permanently conducting. In this manner, all the line sweep pulses F arrive at the line sweep pulse counter 42.

If the multi-position switch 43 is moved to the right by one position, the gate 41 will be controlled by a counter flip-flop 44. This counter flip-flop 44, on one hand, receives through the conductor 45 the image sweep pulses G. These pulses G control the counter flip-flop 44 and make the gate 41 conducting. Accordingly, at the beginning of every half image the line sweep pulses F can arrive at the line sweep pulse counter 42.

The gate 41 remains conducting until the detector circuit 33 emits a control pulse to reverse the counter flip-flop 44. As more closely discussed in the description of FIG. 8, this takes place every time three dark lines have been scanned and the associated line sweep pulses F have been moved through the shift register 34. After the counter flip-flop 44 has been reversed, the gate 41 will be blocking and therefore no more line sweep pulses F are received by the line sweep pulse counter 42. The moment a first half image has been scanned, the counter flip-flop 44 is reversed again by the image sweep pulse G and thereby the gate 41 is made conducting again. Presently, the line sweep pulse counter 42 receives a number of line sweep pulses F until the detector circuit 33 once more displays "marking thread recognized" and generates a corresponding signal to reverse the counter flip-flop 44. Presently, the line sweep pulse counter 42 receives the line sweep pulses F from both half images generated from the beginning of each half image to the scanning of each three dark lines. The sum of these two series of line sweep pulses F then is a measure of the position instantaneously assumed by the marking thread 13, that is, whether it has been moved too much or too little in the transverse direction.

A data flip-flop 46 is connected in parallel with the counter flip-flop 44. This data flip-flop 46 is connected by the multi-position switch 43 to the gate 41 when the spacing between two marking threads must be detected. For that purpose, the data flip-flop 46 is moved by the image sweep pulse G through the conductor 45, by the counter flip-flop 44 and the conductor 47 into a defined position at the beginning of each half image, the gate 41 being blocked in this position. The line sweep pulse counter 42, therefore, first receives no line sweep pulses F. The data flip-flop 46 is reset only by an output pulse from the detector circuit 33 which then makes the gate 41 conducting. As described above, this takes place when three dark lines have been scanned, that is, when a first marking thread has been detected. When the image recorded by the video camera is further scanned, the second and adjacent marking thread will next be detected by again scanning three dark lines, whereupon a corresponding output signal to reset the date flip-flop 46 will be generated in the detector circuit 33. This resetting causes the gate 41 to be blocking again. The line sweep pulse counter 42 thereupon has counted only those line sweep pulses F which occurred between the two adjacent marking threads recorded by the video camera. It must be added for the sake of accuracy that the first three line sweep pulses F generated upon detecting the second marking thread are included in the count. In this case too, the line sweep pulses F from both half images are summed in the line sweep pulse counter 42.

The line sweep pulse counter 43 is connected to a line sweep pulse memory 48 which receives the count from the line sweep pulse counter 42 after two half images have been scanned. This is implemented by means of another counter 49 receiving the output from a high-frequency multivibrator 50. The image sweep pulses G pass through a conductor 51 into the counter 49, with a 2:1 divider 52 being inserted. The divider 52 assures that only every second image sweep pulse G arrives at the counter 49.

When an image sweep pulse G is present, the outputs of the counter 49 are so controlled by the count of the pulses of the astable multivibrator 50 so that a transfer pulse is fed through the conductor 53 to the line sweep pulse memory 48. The count from the line sweep pulse counter 42 then passes into the other. Thereupon, a reset pulse passes through the conductor 54 into the line sweep pulse counter 42 which thereby is reset to zero. Thereupon, the counter 49 blocks itself from further counting. The high frequency of the multivibrator 50 causes this to occur so rapidly that the transfer of the count magnitude and the resetting of the line sweep pulse counter 42 is terminated before the first line sweep pulse F following the image sweep pulse G is received.

The line sweep pulse memory 48 is connected to three outputs, the first of which leads to a digital display 55 of the count magnitude in the line sweep pulse memory 48. The second output forms the binary output for the subsequent regulator 56 while the third output leads to a digital-analogue converter 57 which controls, for instance, a plotter.

Figure 10:
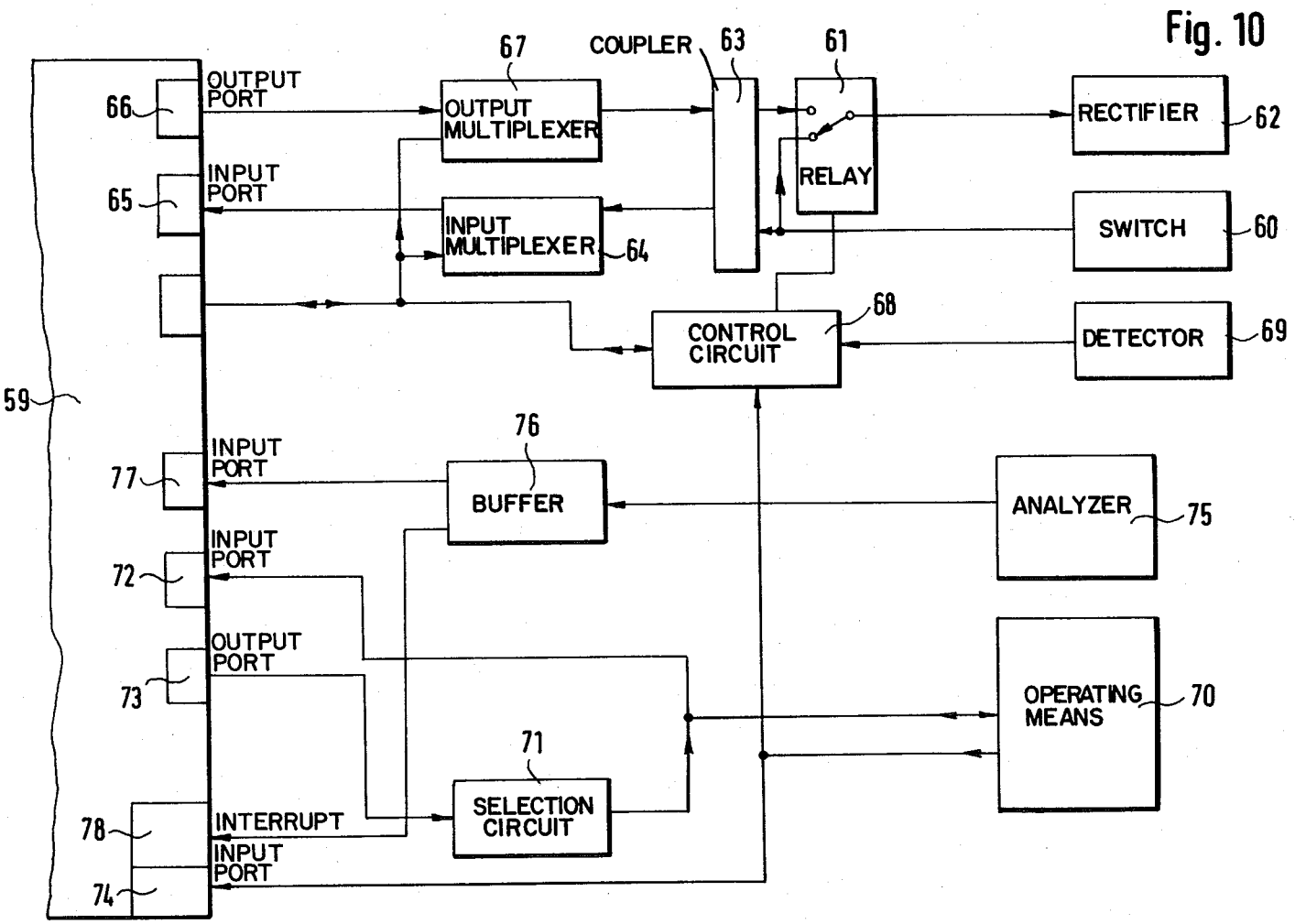

A conductor 58 is connected to the conductor 53 in order to feed synchronizing pulses to the computer shown in FIG. 10.

FIG. 10 discloses the circuit-diagram in block form of the regulator for the PI control which controls the drive of the conveyor chains 5,7, as best shown in FIG. 2. The drive can be controlled so that the actual transverse motion of the tubular felt 3 corresponds in as constant a manner as possible to a specific reference value. Due to the high time-constants of the controlled system, a microprocessor-based computer is inserted in the controlled system. Appropriate software controls this microprocessor 59.

The reference value for the transverse motion of the tubular felt 3 is pre-set by means of a switch 60. Switch 60 is connected to relay 61. Relay 61 at the time is in a position connecting the switch 60 directly with a current rectifier 62 for the drive motor of the conveyor chains 6,7. This drive motor, not shown in further detail herein, therefore is not controlled at this very instant, rather it receives only the prestored reference value. This prestored value is fed to the current rectifier 62, particularly when the microprocessor 59 is turned off or when spurious effects have taken place.

The position of the switch 60, and hence the reference value, is then read into the microprocessor 59 through an optical coupler 63, an input multiplexer 64 and an input port 65. After the setting value has been computed, it is fed through the output port 66, the output multiplexer 67, the optical coupler 63 and the relay 61 to the current rectifier 62. Before that, however, the relay 61 must be moved into the automatic position, and, this is performed by using control circuit 68.

The control circuit 68, on one hand, is controlled by another detector circuit 69 which signals to the control circuit 68 whether the needling machine 11 is operating or not. In the latter case, the control circuit 68 causes the microprocessor 59 to cease computing any new setting value. Furthermore, the control circuit 68 is also controlled by an operating means 70. This operating means 70 can be used to manually reverse the relay 61, for instance to interrupt the operation of the microprocessor 59. Furthermore, the operating means 70 is used to transfer the regulation factors for the P and I parts to the micro-processor 59. They must be matched to the time constant of the controlled system determined by the length of the tubular felt and its circumferential speed. A selection circuit 71 is provided to read-in the regulation factors and is connected through an input port 72 and output port 73 to the microprocessor 59. The operating means 70 is further connected through an input port 74 to the microprocessor 59 so that a start pulse can be fed to the microprocessor 59 to set it into a specific initial position. Another switch causes the control circuit 68 to switch the relay 61 into the automatic position.

The analyzer 75, shown in further detail in FIGS. 8 and 9 in this instance, is represented merely by a block. The binary output 56, shown in FIG. 9, passes from this analyzer 75 into a buffer stage 76 transmitting the count of the line sweep pulses F through the input port 77 to the microprocessor 59. Each newly ascertained value triggers an interrupt 78 whereby the microprocessor 59 is notified that the count magnitude is present for a given time interval and in stable manner at the input port 77.

Each second the microprocessor 59 reads-in one value, having previously awaited the synchronizing pulse from the counter 49 of FIG. 9, specific checks can be carried out using corresponding software before the microprocessor 59 does compute a setting value. This includes, in particular, checking whether in fact a marking thread is present within the camera range. If this is not the case, an operational discontinuity takes place in an alarm loop having a corresponding display and ensuing programming termination. If the checks show that the microprocessor 59 must compute a setting value, then the count magnitudes of the line sweep pulses fed to the microprocessor 59 first are compared with the corresponding predetermined reference value and the difference is formed. Then the proportional and integral values are obtained and thereafter the setting value is computed. This is followed by a conversion of the binary value initially present in binary form into a BCD value which then appears on the output. Lastly, reset takes place and the wait for the second synchronizing pulse.

What we claim is:

1. A process for manufacturing and/or treating an endless tubular felt or similar tubular structure whereby a material, for instance a length of fiber web, a coating, longitudinal threads or the like, are deposited in continuous manner on one width of an already prepared tubular felt, at least in part, and rotating circumferentially, and/or whereby the tubular felt is treated in a width, for instance by singeing or needling, which is less than that of the tubular felt, the deposition or the treatment being carried out by a relative motion of, or toward the tubular felt respectively, in helical manner and transversely to its direction of advance, possibly with partial overlap, characterized in that at least one contrasting marking line (13) is continuously deposited along the circumferential direction of the tubular felt (3) and that its position or the spacing from an adjacent marking line located to the rear as seen in the direction of advance is sensed in contact-free manner as the actual value, the relative displacement always being set so that the sensed actual value shall differ as little as possible from a specific reference value.

2. Process per claim 1, characterized in that the position of the marking line is sensed before the tubular felt (3) together with the marking line (13) has completed one full revolution.

3. Process per claim 1, characterized in that the marking line is a marking thread (13).

4. Process per claim 3, characterized in that the marking thread (13) is deposited before the length of fiber web (10) is fixed to the already prepared part of the tubular felt (3).

5. Process per claim 1, characterized in that the marking line (13) contrasts optically with the tubular felt (3) and is sensed optically.

6. Apparatus to produce an endless tubular belt, including at least two mutually spaced conveyor rollers for the already-prepared part of the tubular felt and a feed device to deposit the material and/or a treatment system for the already-prepared part of the tubular felt, a displacing device for the relative motion between the tubular felt and the feed device or the treatment system being provided in the axial direction of the conveyor rollers, characterized by at least one deposition system (12, 16, 17, 18, 19, 20, 21) for the continuous deposition of the marking line (13) on the tubular felt (3) along the latter's circumferential direction and by a contact-free sensor for detecting the position of the marking line (13) or its spacing from an adjacent marking line located as seen in the direction of advance behind the deposition system(s) (12, 16, 17, 18, 19, 20, 21), whereby the deposition system(s) (12, 16, 17, 18, 19, 20, 21) and the sensor are rigidly ganged to the displacement device when the feed device or the treatment system is moved transversely, and whereby the sensor is connected to an electronic analyzer (75) for ascertaining the difference between the actual value of the position or the spacing between the marking line(s) as delivered by the sensor and the pertinent reference value, and where the analyzer (75) is connected to a regulator to ascertain a setting value to adjust the drive of the displacement device (6,7,8,9) towards minimizing the difference.

7. Apparatus per claim 6, characterized in that the sensor (15) is mounted in the vicinity of the marking line (13) shortly before the completion of one revolution and is designed to detect the position of the marking line (13).

8. Apparatus per claim 6, characterized, in that the sensor includes a picture-recording device (15).

9. Apparatus per claim 8, characterized in that the picture-recording device is a video-camera (15).

10. Apparatus per claim 9, characterized in that the video camera (15) is mounted in such manner that the marking line(s) (13) run(s) parallel to the scan lines of the video camera.

11. Apparatus per claim 10, characterized in that the video camera (15) and the marking line(s) (13) are mutually adjusted so that the marking line(s) (13) take(s) up at least six scan lines.

12. Apparatus per claim 9, characterized in that the analyzer (75) is provided with a detector circuit to sense the marking line(s) (13) and a counting circuit (42) to count the scan lines from the beginning of the image to the video signal of the marking line(s) (13) and/or between two such video signals, the count magnitude being the actual value for the regulator.

13. Apparatus per claim 12, characterized in that the detector circuit (33) includes a shift register (34) synchronized by the line sweep pulses (F) of the video camera (15) and being reset by the image sweep pulses (G) of the video camera, for moving through line sweep pulses (F), the video signal (H) controlling an input port (38) so that only the line sweep pulses (F) enter the shift register (34) in the presence of the video signal (H) generated upon detecting the marking thread (13).

14. Apparatus per claim 13, characterized in that the shift register (34) is followed by an AND circuit (3) emitting a signal only upon three consecutive line sweep pulses (F).

15. Apparatus per claim 12, characterized in that the counter circuit consists of a line sweep pulse counter (42), of a line sweep pulse memory (48) connected thereto and of a counter (49) fed from a multivibrator, said counter (49) being controlled by every second image sweep pulse (G) so that the line sweep pulse memory (42) receives a transfer pulse to receive the count magnitude in the line sweep pulse counter (42) and thereupon the line sweep pulse counter (42) receives a reset pulse before the next line sweep pulse (F) arrives.

16. Apparatus per claim 15, characterized in that a gate (41) precedes the input of the line sweep pulse counter (42) and is controlled by the detector circuit (33) through a count flip-flop (44) in such a manner that in the presence of a signal from the detector circuit (33) it will be blocking and in the presence of an image sweep pulse (G) it will be conducting.

17. Apparatus per claim 16, characterized in that a data flip-flop (46) is in parallel with the count flip-flop (44) and can be switched in lieu of the count flip-flop (44) to the gate (41) and is so controlled by the count flip-flop (44) and the detector circuit (33) that in the presence of a first signal from the detector circuit (33) the gate (41) will be conducting and in the presence of a second signal it will again be blocking.

18. Apparatus per claim 6, characterized in that the regulator is designed as a PI control.

19. Apparatus per claim 6, characterized in that the regulator is digitally controlled by means of a microprocessor (59).

20. Apparatus per claim 19, characterized in that an optical coupler (63) is provided for the input of the actual value and the output of the setting value.

* * * * *